US007185687B1

(12) United States Patent
Mattison

(10) Patent No.: US 7,185,687 B1
(45) Date of Patent: Mar. 6, 2007

(54) PURSE ORGANIZING SYSTEM

(76) Inventor: Delpha Mattison, 5205 W. 37th St., Sioux Falls, SD (US) 57106

( * ) Notice: Subject to any disclaimer, the term of this patent is extended or adjusted under 35 U.S.C. 154(b) by 0 days.

(21) Appl. No.: 10/994,660

(22) Filed: Nov. 22, 2004

Related U.S. Application Data

(63) Continuation-in-part of application No. 10/623,063, filed on Jul. 18, 2003, now abandoned.

(51) Int. Cl.
*A45C 1/02* (2006.01)
*A45C 3/08* (2006.01)

(52) U.S. Cl. ..... 150/113; 150/112; 190/110

(58) Field of Classification Search ..... 150/112, 150/113; 190/110; 206/581, 538; 220/528, 220/555, 527; 132/316; 383/38
See application file for complete search history.

(56) References Cited

U.S. PATENT DOCUMENTS

| | | | | | |
|---|---|---|---|---|---|
| 1,089,939 | A | | 3/1914 | Maxwell | |
| 1,206,276 | A | * | 11/1916 | Wallach | 190/109 |
| 2,009,077 | A | | 7/1935 | Walitsky | |
| 2,335,898 | A | | 12/1943 | Arnold | |
| 2,397,225 | A | * | 3/1946 | Walters | 292/194 |
| 2,604,917 | A | * | 7/1952 | Reilly | 150/111 |
| 2,675,042 | A | * | 4/1954 | Herrera | 150/112 |
| 2,695,112 | A | * | 11/1954 | Bonnevay | 217/7 |
| 2,781,180 | A | * | 2/1957 | Malta-Nielsen | 242/146 |
| 2,899,998 | A | * | 8/1959 | Carroll | 150/113 |
| 2,911,024 | A | * | 11/1959 | Miceli | 150/113 |
| 3,258,017 | A | * | 6/1966 | Dorotha | 132/315 |
| 3,259,269 | A | * | 7/1966 | Asenbauer | 206/509 |
| 3,817,372 | A | | 6/1974 | Smith | |
| 4,098,312 | A | * | 7/1978 | McCain | 150/106 |
| 4,163,496 | A | * | 8/1979 | Dogliotti | 206/538 |
| 4,192,439 | A | * | 3/1980 | Segal | 222/130 |
| 4,210,186 | A | * | 7/1980 | Belenson | 206/316.2 |
| 4,260,004 | A | * | 4/1981 | Domke | 206/316.2 |
| 4,263,951 | A | | 4/1981 | Siegel | |
| 4,446,966 | A | * | 5/1984 | Moloney | 206/708 |
| D295,796 | S | * | 5/1988 | Wadsworth et al. | D28/77 |
| 4,784,304 | A | * | 11/1988 | Schweitzer | 224/610 |
| 4,807,760 | A | * | 2/1989 | Sussman | 206/581 |
| 4,811,769 | A | | 3/1989 | Phares | |
| 4,944,391 | A | | 7/1990 | Johnson | |
| 5,038,842 | A | | 8/1991 | Haung | |
| 5,441,153 | A | * | 8/1995 | Lahaye | 206/581 |
| 5,803,244 | A | * | 9/1998 | Shefler et al. | 206/6 |
| 5,839,553 | A | * | 11/1998 | Dorsam | 190/109 |

(Continued)

FOREIGN PATENT DOCUMENTS

FR 2577773 A3 * 8/1986

*Primary Examiner*—Sue A. Weaver

(57) ABSTRACT

A purse organizing system is disclosed for removably positioning in a purse. The purse organizing system comprises an insert having a top and a bottom and being elongated between opposite ends. The insert includes a pair of laterally spaced side walls with the side walls each having opposite ends. The insert also includes a pair of longitudinally spaced end walls with each of the end walls extending between the side walls. The insert also includes a bottom wall extending between the side walls and the end walls for closing a bottom and creating an interior. An open top is located opposite the closed bottom. The insert also includes at least one divider wall extending laterally between the side walls to divide the interior into two compartments.

23 Claims, 6 Drawing Sheets

U.S. PATENT DOCUMENTS 5,881,850 A 3/1999 Murdoch
5,983,969 A 11/1999 Morgan
6,179,102 B1 * 1/2001 Weber et al. ..... 190/109
6,945,293 B1 * 9/2005 Newton ..... 150/113
2003/0029534 A1 2/2003 Ma

* cited by examiner

PURSE ORGANIZING SYSTEM

CROSS REFERENCE TO RELATED APPLICATION

This application is a continuation-in-part of my U.S. patent application Ser. No. 10/623,063, filed Jul. 18, 2003, now abandoned.

BACKGROUND OF THE INVENTION

1. Field of the Invention

The present invention relates to purse insert devices and more particularly pertains to a new purse organizing system for restricting movement of items about the interior of a purse and making the items easier to retrieve.

2. Description of the Prior Art

A multitude of various purse insert devices have been proposed in the prior art for holding various items in the purse of the user. However, the known inserts have suffered from a number of drawbacks. For example, inserts that are designed to have a relatively large capacity tend to be bulky and occupy a significant portion of the interior of the purse, even when these inserts are relatively empty. Smaller inserts take up relatively less room in the interior of the purse, but also are not able to hold as much. Collapsible or soft-sided inserts tend to take up less room in the interior of the purse when empty or nearly empty, but these inserts typically do not protect the items from crushing inside the purse. Some of the known inserts include a single compartment that may permit smaller items to fall over in the interior of the insert, while other inserts include dividers for creating separate compartments that may or may not be of a suitable size for carrying the desired items. Some known inserts have a shape that makes the remainder of the interior of the purse difficult to carry larger or relatively elongate items.

The purse organizing system according to the present invention substantially departs from the conventional concepts and designs of the prior art, and in so doing provides an apparatus primarily developed for the purpose of restricting movement of items about the interior of a purse and making the items easier to retrieve.

SUMMARY OF THE INVENTION

In view of the foregoing disadvantages inherent in the known types of purse insert devices now present in the prior art, the present invention provides a new purse organizing system construction wherein the same can be utilized for receiving items to restrict their movement about the interior of the purse, while holding the items in a manner that protects the items from being crushed and makes the items easier to retrieve.

To attain this, the present invention generally comprises a purse organizing system for removably positioning in a purse. The purse organizing system comprises an insert having a top and a bottom and being elongated between opposite ends. The insert includes a pair of laterally spaced side walls with the side walls each having opposite ends. The insert also includes a pair of longitudinally spaced end walls with each of the end walls extending between the side walls. The insert also includes a bottom wall extending between the side walls and the end walls for closing a bottom and creating an interior. An open top is located opposite the closed bottom. The insert also includes at least one divider wall extending laterally between the side walls to divide the interior into two compartments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
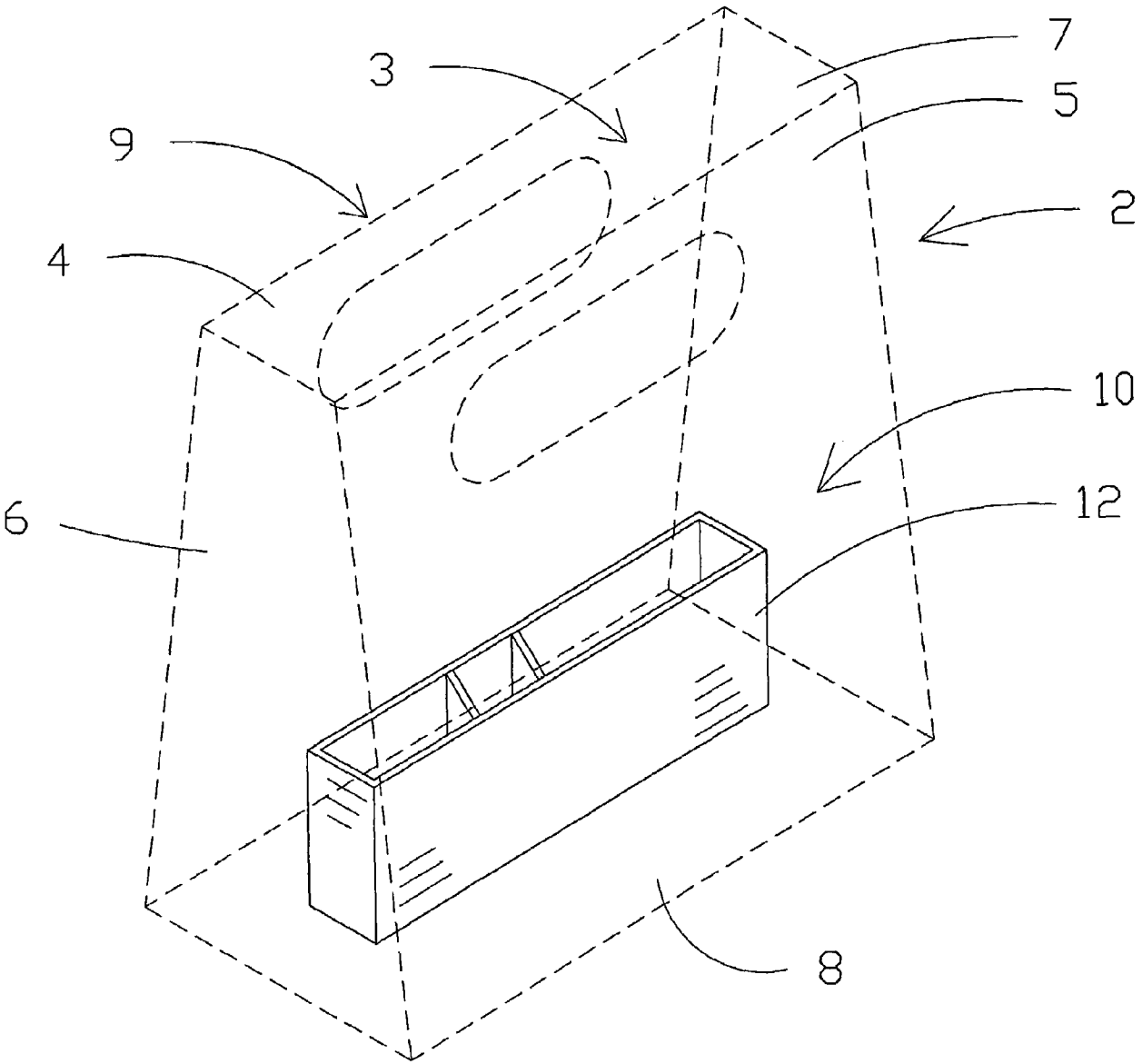
FIG. 1 is a schematic perspective view of a new purse organizing system according to the present invention shown in a purse depicted in broken lines.

With reference now to the drawings, and in particular to FIGS. 1 through 6 thereof, a new purse organizing system embodying the principles and concepts of the present invention and generally designated by the reference numeral 10 will be described.

The invention contemplates a purse organizing system 10 that is suitable for removably positioning in a purse 2 having a pair of side wall portions 4, 5, end wall portions 6, 7, and a bottom wall portion 8 opposite of an upper opening 9. The wall portions collectively define an interior 3 of the purse 2 which is accessible through the upper opening 9.

The purse organizing system 10 includes an insert 12 having a top 14 and a bottom 16 and is elongated between opposite ends 18, 19. The insert 12 comprises a pair of laterally spaced side walls 20, 21, and the side walls each have opposite ends 22, 23. The side walls 20, 21 may be oriented substantially parallel to each other. The insert 12 also comprises a pair of longitudinally spaced end walls 24, 25, each of which extends between the side walls 20, 21. The end walls 24, 25 are most preferably oriented substantially perpendicular to the side walls 20, 21. Each of the end walls 24, 25 may be located between respective ends 22, 23 of the side walls. The insert 12 may also comprise a bottom wall 26 that extends between the side walls 20, 21 and the end walls 22, 23 for closing the bottom 16 of the insert and creating an interior 28. The insert 12 also preferably includes an open top 30 that is located opposite of the closed bottom 16.

The insert 12 may also include at least one divider wall 32 that extends laterally between the side walls 20, 21 to divide the interior 28 into two compartments 34, 36. The compartments 34, 36 may comprise first 34 and second 36 compartments. The divider wall 32 may have an upper edge 40, and the upper edge may have a concave shape extending toward the bottom for permitting easier finger gripping of items held in one of the compartments, especially if the item fits relatively snugly in the compartment. The concave upper edge 40 may be arcuate or curved in shape, or may be substantially V-shaped with the apex of the V-shape being oriented toward the bottom wall 26 of the insert 12.

Optionally, a second divider wall 42 may be included on the insert 12. The second divider wall 42 may extend laterally between the side walls 20, 21 to create a third compartment 38 in the interior 28 of the insert 12. The third compartment 38 may be located between the first 34 and second 36 compartments. Each of the compartments 34, 36, 38 may have a length Lc (see FIG. 5) in the longitudinal direction of the insert 12. Optionally, the lengths of the first 34 and second 36 compartments may be substantially equal. Optionally, the lengths of the first 34 and second 36 compartments may be greater than the length of the third compartment 38 so that the third compartment is more suitable for holding elongate objects in a relatively upright position in the interior of the purse, while the first and second compartments are more suitable for holding broader items, or elongate items in a relatively horizontal position. As a further option, the length of the third compartment 38 may be substantially equal to the width of the third compartment such that the third compartment is substantially square in plan.

Optionally, the length of each of the first 34 and second 36 compartments may be approximately three times the length of the third compartment 38.

Each of the first 34 and second 36 compartments may be elongated with a length of each of the compartments in the longitudinal direction of the insert 12 being greater than a width Wc (see FIG. 5) of each of the compartments in a direction transverse to the longitudinal direction of the insert. Optionally, the widths of the compartments 34, 36, 38 may be substantially equal to each other so that the width profile of the insert 12 is relatively uniform along the entire length of the insert 12.

Significantly, the side 20, 21 and end 24, 25 walls may be substantially transparent to permit the user to view the interior of the compartments (and the contents held therein) through the walls. Optionally, the side 20, 21 and end 24, 25 walls may be substantially opaque to conceal the interior of the compartments (and the contents held therein) from view through the walls.

Each of the side walls 20, 21 has a height Hsw and a length Lsw (see FIG. 5), and optionally the length of each of the side walls is approximately three times the height of the side wall. Each of the end walls 24, 25 has a height Hew and a width Wew (see FIG. 5), and optionally the height of each of the end walls is approximately twice the width of the end walls.

As a further option, at least one of the compartments 34, 36, 38 is elongated in a direction parallel to an axis extending perpendicular to the end walls, and in one embodiment of the invention, the first 34 and second 36 compartments may both be elongated in such a manner.

Preferably, the first divider wall 32 and the second divider wall 42 are immovable with respect to the side walls 20, 21 of the insert to resist crushing of the contents of the compartments caused by unintended or accidental movement of the divider walls which could shrink or constrict the size of one of the compartments on its contents.

Significantly, each of the side walls 20, 21 and end walls 24, 25 may be substantially rigid in order to resist crushing of the insert (and the contents of the insert) when it is placed in a purse. Further, the first 32 and second 42 divider walls may also be substantially rigid to help buttress the side walls 20, 21 from being crushed inward toward each other and collapsing on the contents of the compartments.

Figure 2:
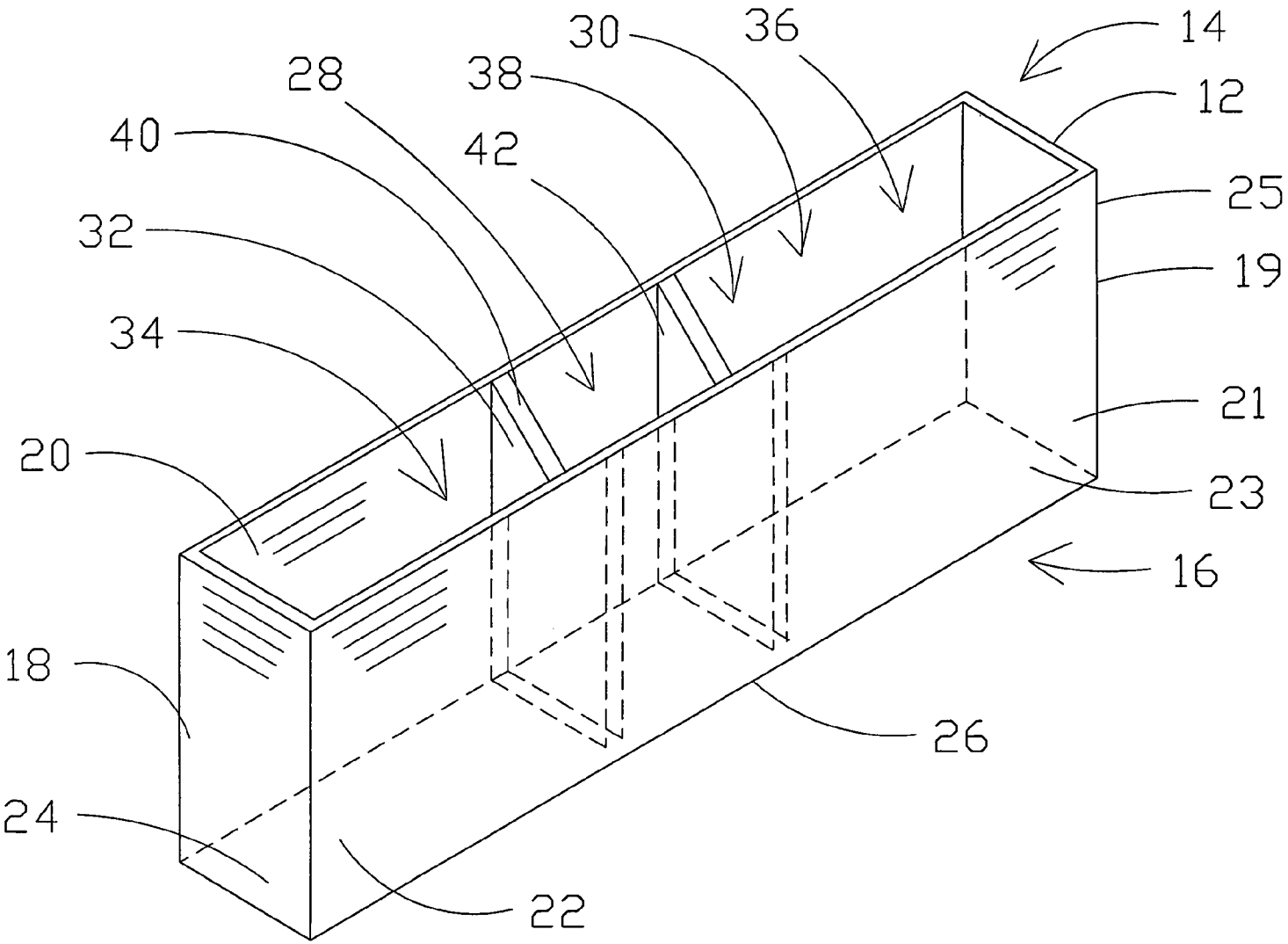
FIG. 2 is a schematic perspective view of a first configuration of the purse insert of the present invention.

In one illustrative embodiment of the invention, generally represented in FIG. 2 of the drawings, the insert 12 has a length of approximately 8.75 inches and a width of approximately 1.375 inches, and thus each of the side walls 20, 21 has a length of approximately 8.75 inches and each of the end walls 24, 25 has a length of approximately 1.375 inches. The height of the insert is approximately 3 inches. The first 34 and second 36 compartments may each have a length (in the longitudinal direction of the insert 12) of approximately 3.75 inches, and the third compartment 38 has a length of approximately 1.25 inches.

Figure 3:
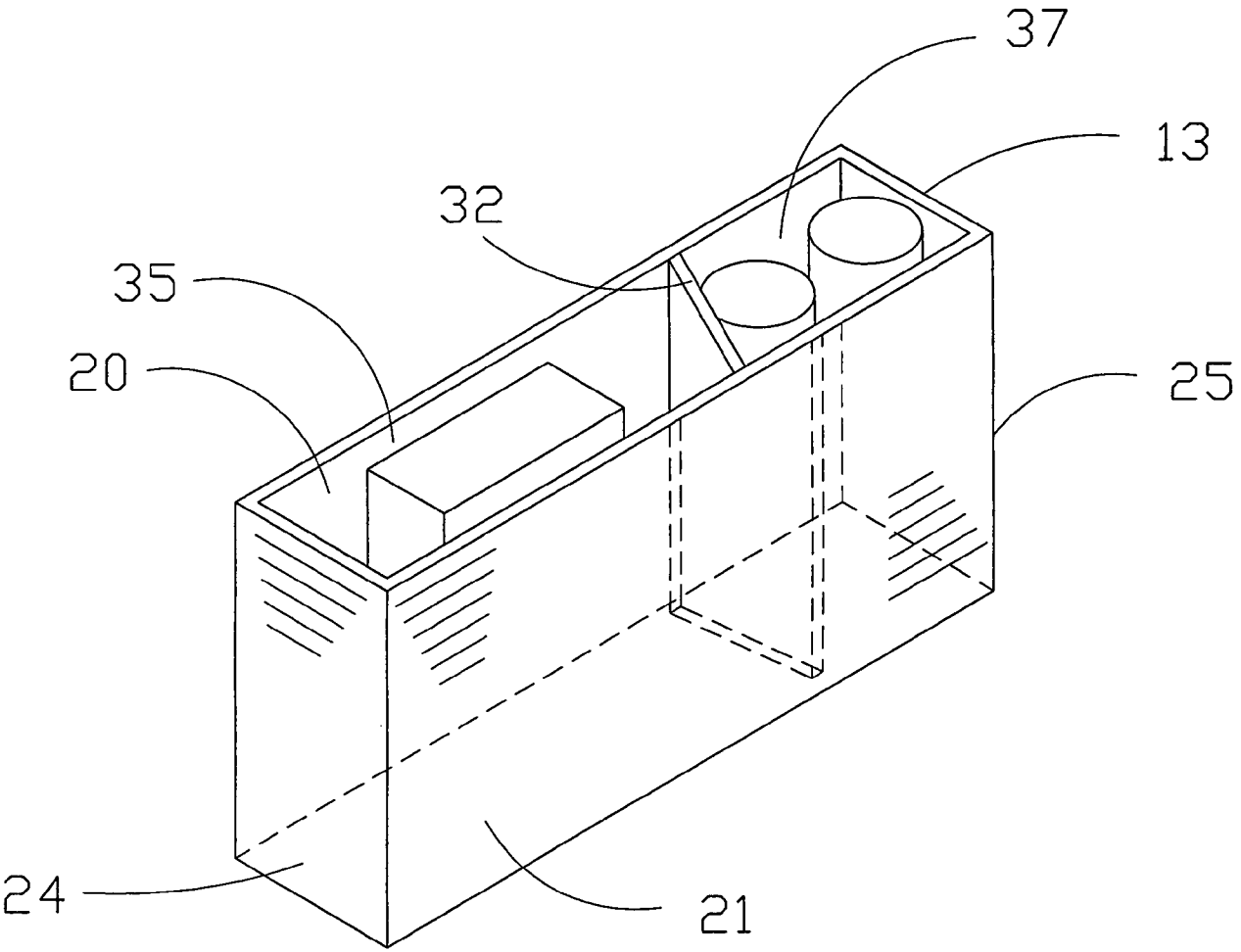
FIG. 3 is a schematic perspective view of a second configuration of the purse insert of the present invention.
Figure 4:
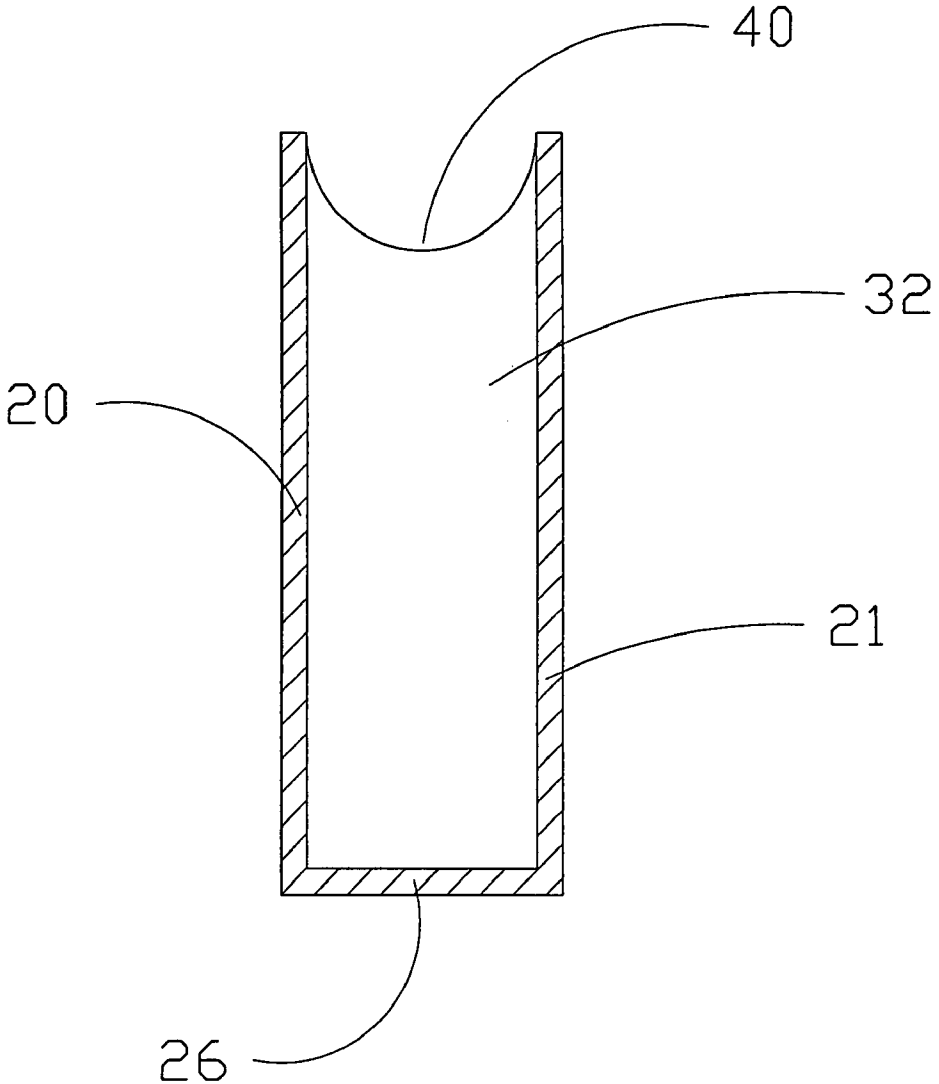
FIG. 4 is a schematic sectional view of the present invention showing an optional divider wall configuration.

In another illustrative embodiment of the invention, generally represented in FIG. 3 of the drawings, the insert 13 has a length of approximately 6 inches and a width of approximately 1.375 inches, and thus each of the side walls 20, 21 has a length of approximately 6 inches and each of the end walls 24, 25 has a length of approximately 1.375 inches. The height of the insert is approximately 3 inches. The first compartments 35 of the insert 13 may each have a length (in the longitudinal direction of the insert 13) of approximately 3.75 inches, and the second compartment 37 has a length of approximately 1.375 inches.

In use, the insert 12 may be placed into the interior 3 of the purse 2 and may be placed on the bottom wall portion 8 of the purse, either adjacent to one of the side wall portions 4, 5 or spaced from the side wall portions toward a center of the bottom wall portion of the purse (see FIG. 1). Optionally, due to the relatively elongate, thin nature of the insert, a second insert 13 may also be placed in the interior 3 of the purse 2 alongside the first purse insert 12. Items may be placed into the compartments of the inserts according to their best fit in the differently-sized compartment interiors.

Figure 5:
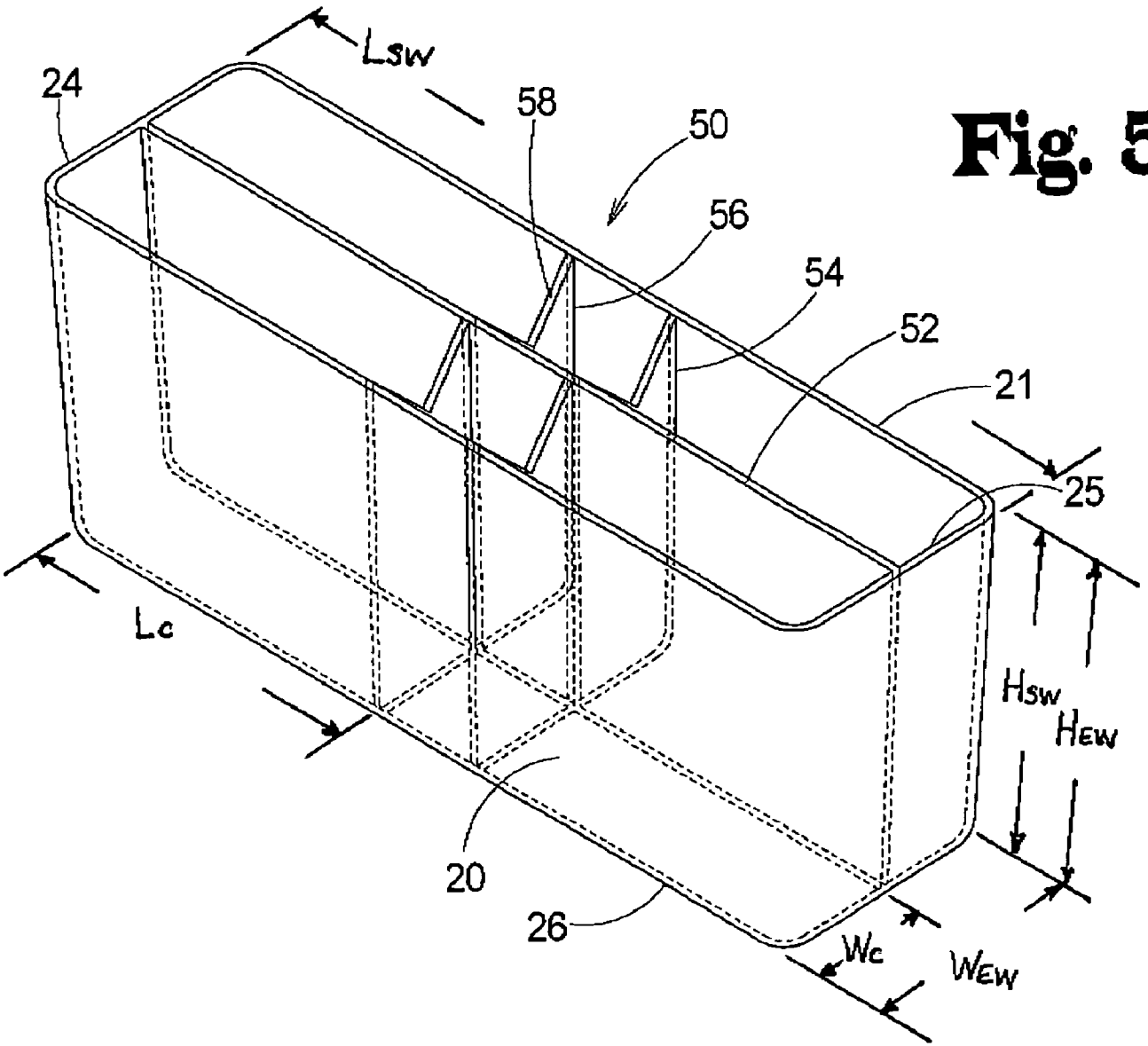
FIG. 5 is a schematic perspective view of an optional configuration of the present invention.
Figure 6:
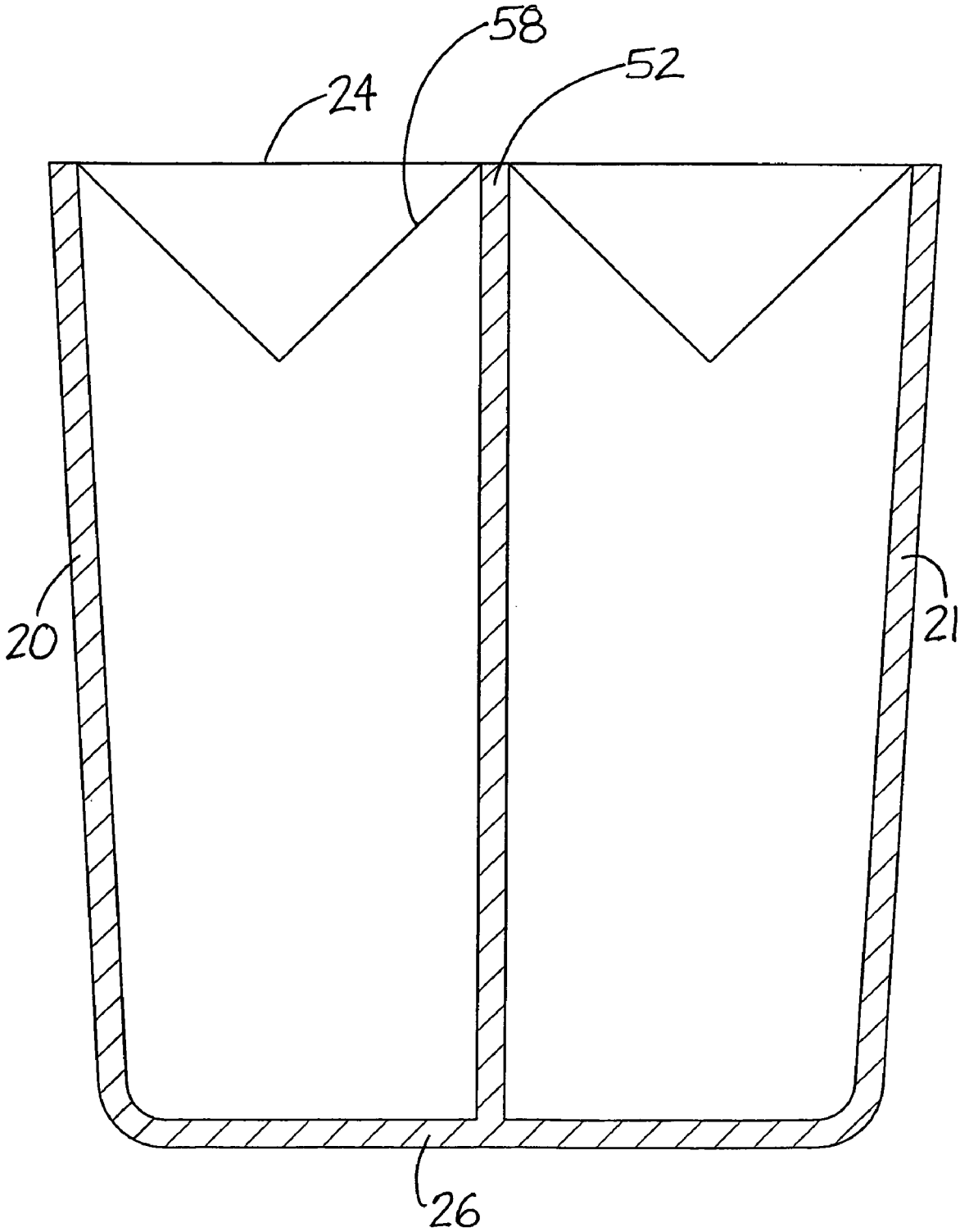
FIG. 6 is a schematic transverse sectional view of the optional configuration of FIG. 5.

In an optional configuration of the invention, the side-by-side arrangement alluded to above may be permanently embodied in the optional configuration of the insert 50 of the invention shown in FIGS. 5 and 6. The insert 50 includes at least one longitudinal divider wall 52 that extends longitudinally between the side walls 20, 21. The longitudinal divider wall 52 may extend substantially parallel to the side walls 20, 21. The longitudinal divider wall 52 may also be substantially equally spaced from each of the side walls 20, 21. A lateral divider wall 54 may extend between the longitudinal divider wall 52 and one 20 of the side walls. In some embodiments of the invention, a pair 54, 56 of lateral divider walls extend in substantially opposite directions from the longitudinal divider wall 52 to a respective side wall 20, 21. Each of the pair of lateral divider walls 54, 56 has an upper edge 58, and the upper edge of each of the lateral divider walls may have a concave shape. The longitudinal divider wall 52 may have a height that is substantially equal to a height of each of the side walls 20, 21.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A purse organizing system for removably positioning in a purse having a pair of side wall portions, end wall portions and a bottom wall portion opposite of an upper opening, the purse organizing system comprising:

an insert having a top and a bottom and being elongated between opposite ends, the insert comprising:

a pair of laterally spaced side walls, the side walls each having opposite ends;

a pair of longitudinally spaced end walls, each of the end walls extending between the side walls;

a bottom wall extending between the side walls and the end walls for closing a bottom and creating an interior, an open top being located opposite the closed bottom; and at least one divider wall extending laterally between the side walls to divide the interior into two compartments;

wherein the side walls, end walls, and the at least one divider wall are configured such that the two compartments are elongated; and wherein each of the two elongated compartments has a longitudinal axis, the longitudinal axes of the two compartments being collinear such that the insert is elongated in a dimension oriented parallel to the longitudinal axes of the two compartments;

wherein the at least one divider wall extends substantially perpendicular to the longitudinal axes of the two elongated compartments, the at least one divider wall having an upper edge with a concave shape extending toward the bottom for facilitating finger gripping of items when the items are positioned in one of the compartments.

2. The system of claim 1 wherein the concave upper edge is arcuate.

3. The system of claim 1 wherein the concave upper edge is substantially V-shaped.

4. The system of claim 1 wherein the two compartments include a first compartment and a second compartment, a width of the first compartment being substantially equal to a width of the second compartment.

5. The system of claim 1 wherein the side and end walls are substantially transparent for permitting viewing of the interior through the walls.

6. The system of claim 1 wherein the side and end walls are substantially opaque for concealing the interior from view through the walls.

7. The system of claim 1 wherein each of the side walls has a height and a length, and wherein the length of the side wall is approximately three times the height of the side wall.

8. The system of claim 1 wherein each of the end walls has a height and a width, and wherein the height of the end wall is approximately twice the width of the end wall.

9. The system of claim 1 wherein the divider wall is immovable with respect to the side walls.

10. The system of claim 1 wherein each of the side walls and end walls is substantially rigid to resist crushing when placed in a purse.

11. The system of claim 1 wherein the insert includes at least one longitudinal divider wall extending longitudinally between the side walls.

12. The system of claim 11 wherein the at least one longitudinal divider wall extends substantially parallel to the side walls.

13. The system of claim 11 wherein the at least one longitudinal divider wall is substantially equally spaced from each of the side walls.

14. The system of claim 11 wherein the insert includes a lateral divider wall extending between the longitudinal divider wall and one of the side walls.

15. The system of claim 11 wherein the insert includes a pair of lateral divider walls extending in substantially opposite directions from the longitudinal divider wall to respective side walls.

16. The system of claim 15 wherein each of the pair of lateral divider walls has an upper edge and the upper edge of each of the lateral divider walls has a concave shape.

17. The system of claim 1 wherein the insert includes at least one longitudinal divider wall extending longitudinally between the side walls, the at least one longitudinal divider wall extending substantially parallel to the side walls, the at least one longitudinal divider wall being substantially equally spaced from each of the side walls, the at least one divider wall comprising a pair of lateral divider walls extending in substantially opposite directions from the longitudinal divider wall to a respective one of the side walls, each of the pair of lateral divider walls having a concave shape, the longitudinal divider wall having a height substantially equal to a height of each of the side walls.

18. The system of claim 1 wherein the two elongated compartments form a first pair of elongated compartments, and additionally comprising at least one longitudinal divider wall extending substantially parallel to the side walls defining a second pair of elongated compartments, each compartment of the second pair of elongated compartments has a longitudinal axis, the longitudinal axes of the elongated compartments of the second pair of elongated compartments being oriented substantially parallel to, and laterally spaced from, the longitudinal axes of the first pair of elongated compartments.

19. The system of claim 1 wherein the insert includes a second divider wall that extends laterally between the side walls to create a compartment between ends of the two elongated compartments.

20. The system of claim 1 wherein the two elongated compartments form a first pair of elongated compartments, and additionally comprising at least one longitudinal divider wall extending substantially parallel to the side walls defining a second pair of elongated compartments, each compartment of the second pair of elongated compartments has a longitudinal axis, the longitudinal axes of the elongated compartments of the second pair of elongated compartments being oriented substantially parallel to, and laterally spaced from, the longitudinal axes of the first pair of elongated compartments.

21. The system of claim 1 wherein the two elongated compartments form a first pair of elongated compartments, and additionally comprising at least one longitudinal divider wall extending substantially parallel to the side walls defining a second pair of elongated compartments, each compartment of the second pair of elongated compartments has a longitudinal axis, the longitudinal axes of the elongated compartments of the second pair of elongated compartments being oriented substantially parallel to, and laterally spaced from, the longitudinal axes of the first pair of elongated compartments;

wherein lengths of each of the elongated compartments of the first and second pair of compartments are substantially equal, and lengths of each of the interposed compartments being approximately one third of the lengths of the elongated compartments of the first and second pairs.

22. The system of claim 1 wherein the insert includes a second divider wall that extends laterally between the side walls to create a compartment between ends of the two elongated compartments; and wherein the second divider wall extends substantially perpendicular to the longitudinal axes of the two elongated compartments, the second divider wall having an upper edge with a concave shape extending toward the bottom for facilitating finger gripping of items when the items are positioned in one of the compartments.

23. A purse organizing system for removably positioning in a purse having a pair of side wall portions, end wall portions and a bottom wall portion opposite of an upper opening, the purse organizing system comprising;

an insert having a top and a bottom and being elongated between opposite ends, the insert comprising:

a pair of laterally spaced side walls, the side walls each having opposite ends;

a pair of longitudinally spaced end walls, each of the end walls extending between the side walls;

a bottom wall extending between the side walls and the end walls for closing a bottom and creating an interior, an open top being located opposite the closed bottom; and at least one divider wall extending laterally between the side walls to divide the interior into two compartments;

wherein the at least one divider wall extends substantially perpendicular to the longitudinal axes of the two elongated compartments, the at least one divider wall having an upper edge a concave shape extending toward the bottom for facilitating finger gripping of items when the items are positioned in one of the compartments, the concave upper edge being arcuate;

wherein each of the compartments is elongate with a length of each of the compartments being greater than a width of each of the compartments;

wherein widths of the compartments are substantially equal to each other;

wherein the insert includes a second divider wall that extends laterally between the side walls to create a third compartment in the interior;

wherein the third compartment is located between a first one and a second one of the two compartments, each of the compartments having a length;

wherein the length of the first and second compartments being substantially equal;

wherein the lengths of the first and second compartments being greater than the length of the third compartment;

wherein the length of each of the first and second compartments being approximately three times the length of the third compartment;

wherein the side and end walls are substantially transparent for permitting viewing of the interior through the walls, wherein each of the side walls has a height and a length, and wherein the length of the side wall is approximately three times the height of the side wall;

wherein each of the end walls has a height and a width, and wherein the height of the end wall is approximately twice the width of the end wall;

wherein the divider wall is immovable with respect to the side walls; and wherein each of the side walls and end walls is substantially rigid to resist crushing when placed in a purse.

* * * * *